United States Patent [19]

Jasper et al.

[11] 4,105,397

[45] Aug. 8, 1978

[54] BARK BURNING SYSTEM

[75] Inventors: Martin T. Jasper, Mississippi State, Miss.; Peter Koch, Alexandria, La.

[73] Assignee: The United States of America as represented by the Secretary of Agriculture, Washington, D.C.

[21] Appl. No.: 751,634

[22] Filed: Jan. 10, 1977

[51] Int. Cl.[2] ..... F27B 19/00

[52] U.S. Cl. ..... 432/90; 34/13.8; 110/210; 110/251; 432/1

[58] Field of Search ..... 34/13.4, 13.8; 110/28 K, 49 R, 7 A, 7 R, 18 R; 432/1, 90

[56] References Cited

U.S. PATENT DOCUMENTS

| | | | |
|---|---|---|---|
| 1,413,018 | 4/1972 | Fujino | 34/13.4 X |
| 3,744,440 | 7/1973 | Gardner | 110/18 R |
| 3,837,303 | 9/1974 | Baardson | 110/7 A |
| 4,030,895 | 6/1977 | Caughey | 110/7 R |

*Primary Examiner*—John J. Camby
*Attorney, Agent, or Firm*—M. Howard Silverstein; David G. McConnell

[57] ABSTRACT

Green bark particles are conveyed slowly downward through a drying chamber countercurrently to rising hot combustion gases in a surrounding annular combustion zone. Bark discharges from the bottom of the drying chamber as fuel into the combustion zone. Hot combustion gases leaving the zone are utilized to supply heat or power to a sawmill.

1 Claim, 2 Drawing Figures

BARK BURNING SYSTEM

BACKGROUND OF THE INVENTION

1. Field of the Invention

This invention relates to the utilization of by-products and wastes from sawmills as a source of heat or power for such mills. More particularly, it relates to a system for burning such materials to produce heat or power. Still further, it relates to utilizing green bark in such a system.

2. Description of the Prior Art

In the prior art, particulate by-products such as wood chips, sawdust, and planer shavings have been utilized as fuel in fixed beds, fluidized inert beds, or vortex-type combustion chambers to provide heat or power for sawmills. However, these materials are fast becoming too valuable to burn. While green bark has been considered as an alternative fuel in such systems, it must be partially dried (i.e., down to about 35% moisture, total weight basis) before it will significantly burn. Heretofore, no practical system for drying and thereafter burning such bark has been developed.

SUMMARY OF THE INVENTION

A novel and practical combustion system for such green bark has now been developed, wherein particulate green bark is passed through a drying zone adjacent an annular combustion zone, to indirectly heat the bark and form dried bark. Thereafter, the dried bark is injected as fuel into the combustion zone. Hot combustion gases exiting from the combustion zone are then utilized as a heat or power source in a sawmill. In particular, such hot gases may be utilized to generate steam requirements for the plant, or to dry lumber in a direct fire kiln (i.e., a kiln in which lumber is directly heated with hot gases as opposed to low pressure steam heating).

It is therefore an object of the present invention to provide an integrated system for drying and burning green bark.

Another object is to provide a low investment system in which available green bark can be burned in a simple suspended particle furnace to supply heat or power to a sawmill.

Still another object is to provide a practical system wherein green bark can be burned to supply hot gases for a direct-fire lumber drying kiln, without the intermediate step of steam manufacture.

DESCRIPTION OF PREFERRED EMBODIMENTS

Figure 1:
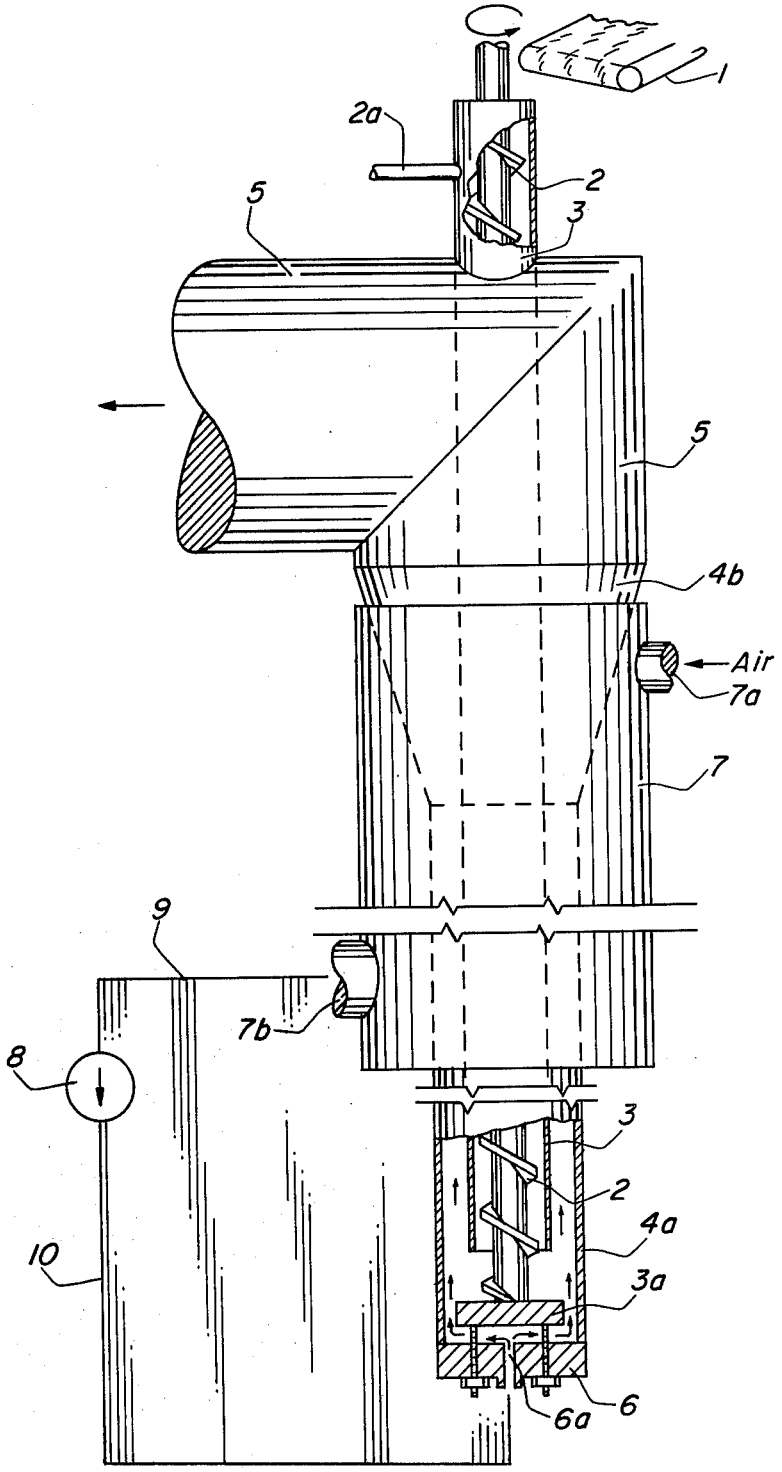
FIG. 1 is a partially-sectioned, partially-schematic, perspective view of the dryer-burner apparatus of the present invention.

Apparatus of the present invention is shown in FIG. 1, wherein reference numeral 1 designates a belt conveyor to transport green particulate bark from a storage bin (not shown) to a downwardly directed rotating feed screw or auger 2 which is substantially enclosed by an elongated, generally vertically disposed cylindrical wall or housing 3.

Conventional motor means (not shown) are employed to drive the feed screw, which is journaled for rotation on a bearing surface (not shown) in bottom plate 3*a*. A conduit 2*a* conveys air or another suitable gas into the feed auger zone, to maintain such zone under a slight positive pressure.

Particulate bark for conveyor 1 is produced in the prior art manner by first removing bark from a log by, for example, mechanical ring barkers widely used in Southern pine sawmills to remove stringy bark, as well as the more friable outer bark. Thereafter, the bark may be pulverized into particulate form by such devices as the apparatus disclosed in "Pulverization of Southern Pine Bark to be used as Fuel in a Suspension-type Burner", M.S. Thesis, Mississippi State University, J. W. Chenualt, 1973.

Concentrically disposed around, and thereby substantially surrounding, housing 3 is another vertically disposed wall 4*a–b* composed of a cylindrically shaped lower section 4*a* and an outwardly flared upper section 4*b* in the shape of an inverted cone. Wall 4*a–b* terminates at its upper extremity into an elbow-shaped exhaust conduit 5, and is essentially closed at its lower extremity by a bottom plate 6.

Still another wall 7 is concentrically disposed around most of section 4*b* and around the upper part of section 4*a*. Wall 7 is closed at the top and bottom thereof, but is provided with entrance and exit passages 7*a* and 7*b*, respectively.

A compressor 8 pulls air or another suitable oxidizing gas through passage 7*a* into the annular space between wall 7 and wall 4*a–b*, through exit passage 7*b*, and through conduit 9, and then forces such air through conduit means 10, through passage 6*a* in bottom plate 6, then under plate 3*a*, into the annular space between plate 3*a* and wall section 4*a*, and then into the annular space between wall 3 and wall section 4*a*.

Wall 3 terminates above the bottom of feed auger 2 to provide a bark egress opening so that bark discharges from the bottom of the auger immediately into the bottom of the annular chamber defined by wall 3 and wall section 4*a*, and commingles with air rising from passage 6*a*, which passage is appropriately sized or metered to permit the air to entrain the particulate bark entering the chamber.

In operation, green bark, usually having a moisture content of at least 50% (total weight basis), and preferably having a particle size of less than 3/16 inch in largest dimension, passes slowly downward through the drying zone enclosed by wall 3.

Throughout its passage through the drying zone, the particulate bark moves in a countercurrent direction to the gases rising through the adjacent surrounding annular zone defined by walls 3 and 4*a–b*, and is indirectly heated by such gases through the medium of heated wall 3. Additionally, the burning particles in the combustion process come in contact with, and thereby heat, wall 3, to further heat the bark. As a result, bark exits from the drying zone preferably at a moisture content of about 0–20%, based on total weight. At the same time, air is indirectly preheated to a temperature of about 300°–500° F in a similar manner, as the air traverses the annular preheating chamber or space defined by wall 7 and wall 4*a–b*; and the preheated air is then pumped by compressor 8 into the combustion zone. The lowered moisture content of the bark particles exiting from the bottom of the drying zone into the combustion zone promotes their instant ignition in the heated air stream. The slight positive pressure in the drying zone brought about by the injection of gas at conduit 2*a* prevents hot gases and volatiles in the combustion zone and the bottom of the drying zone from rising up through the drying zone.

As hot gases and particles move upwardly from the chamber defined by wall 3 and wall section 4a, and enter the upper part of the combustion zone defined by wall 3 and wall section 4b, such gases and particles traverse an area of progressively greater cross-section in the upward direction, created by the outward flare of section 4b. As a result, there is a loss of upward velocity of gases and particles. This causes particulate matter heavier than flyash to fall back into the lower part of the combustion chamber defined by wall 3 and section 4a, for continuous recirculation until essentially completely burned. Accordingly, the annular combustion area defined by wall 3 and wall section 4b also functions as a gas-solids separation zone.

An ash collector (not shown) may be utilized to entrain and precipitate flyash which exists with combustion gases from the apparatus through exit elbow 5.

While the drying zone is shown in FIG. 1 as traversing exhaust elbow 5, this aspect of design is not essential to the drying operation, because sufficient drying heat is generated by the combustion zone per se.

The combustion zone is preferably operated at temperatures which do not exceed 1800° F so as to avoid formation of troublesome slag.

The present invention is not to be confused with systems which are based on the maintenance of a fluid bed within the combustion zone, such as that shown in "Pulverization of Southern Pine Bark to be Used as Fuel for a Suspension-Type Burner", M.S. Thesis, Mississippi State University, J. W. Chenualt, p. 3, 1973. For that system, reference was made to a defined flame front aspect, specifically a stationary flame front, which would correspond to a stable fluid bed as described in Fluidization, Reinhold Publishing Corporation, D. F. Othmer, p. 1, 1956. In the present invention bark particles are entrained in the total air supply, and combustion occurs throughout the combustion chamber without bed or flame front formation.

Figure 2:
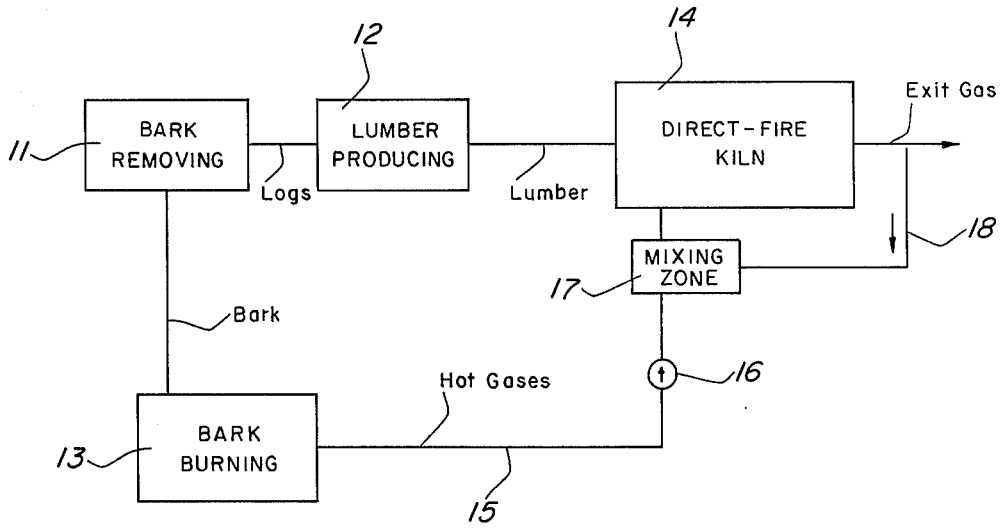
FIG. 2 is a schematic-type view of the dryer-burner in combination with a drying kiln.

Referring to FIG. 2, a system for employing green bark to fuel a direct-fire kiln is shown therein. Referring thereto, green bark is removed from logs in zone 11 in the prior art manner; the logs are converted to lumber in zone 12; the green bark in particulate form is converted to hot combustion gases in zone 13 by the apparatus of the present invention; the lumber from zone 12 is transported to a direct-fire kiln 14; and the hot gases from zone 13 are conveyed by conduit means 15 and fan 16 to the kiln to dry the lumber. Prior to contacting the lumber, such hot gases, which may be at temperatures of 1500°–1600° F, are cooled to 270° F or less by mixing, in zone 17, with outside air or cooler gases exiting from the kiln through conduit 18. A system for controlling temperature and humidity of gases for direct-fire kilns is disclosed in "An Investigation of the Operating Conditions of a Continuous-feed, High-temperature Kiln", M.S. Thesis, Mississippi State University, S. P. Kinard, 1975.

Exemplary dimensions for apparatus of the present invention include: a 2-foot diameter drying zone surrounded by a combustion zone having an overall diameter of 3 feet, 4 inches (which includes the 2-foot drying zone); an 11-horsepower air compressor that withdraws air from the preheating zone which surrounds a 20-foot section of the combustion zone, and delivers such air at a velocity of about 325–375 fpm into the bottom of the combustion chamber.

A material balance on a typical Southern pine sawmill shows that green bark from the mill can be effectively utilized to produce all the high pressure steam requirements for the mill, and to provide substantial amounts of low pressure steam requirements. Alternatively, such bark can be employed to supply more than enough heat to dry the pine lumber in a direct-fire kiln.

What is claimed is:

1. Apparatus for drying and burning particulate bark comprising (a) an elongated, vertically disposed, downwardly directed feed screw;

(b) means to feed particulate bark to the upper section of said screw;

(c) a vertically-disposed cylindrical housing substantially enclosing said feed screw, said housing terminating above the bottom of said feed screw to provide an egress opening for particulate bark from said screw;

(d) a first wall concentrically disposed around said housing and said egress opening, said wall being cylindrically shaped at it lower section thereof, and being flared outwardly in the form of an inverted cone above said lower section; the annular space between said first wall and said housing defining a combustion chamber;

(e) a second wall concentrically disposed around said first wall to define an annular gas preheating chamber therebetween;

(f) openings in said second wall to permit air to enter and leave said annular preheating chamber;

(g) conduit means connected to one of said openings and to the bottom of said combustion chamber to supply preheated air to the bottom of said combustion chamber; and (h) air metering means at the bottom of said combustion chamber to permit said preheated air to entrain particulate bark which enters said combustion chamber from said egress opening disposed below the bottom of said cylindrical housing.

* * * * *